US006604808B2

(12) United States Patent
King et al.

(10) Patent No.: US 6,604,808 B2
(45) Date of Patent: Aug. 12, 2003

(54) METHOD FOR DETERMINING THE SKEW OF A PRINTHEAD OF A PRINTER

(75) Inventors: David Golman King, Shelbyville, KY (US); Patrick Laurence Kroger, Versailles, KY (US); Randall David Mayo, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/898,372

(22) Filed: Jul. 3, 2001

(65) Prior Publication Data

US 2003/0007025 A1 Jan. 9, 2003

(51) Int. Cl.[7] ..... B41J 29/393
(52) U.S. Cl. ..... 347/19; 400/74
(58) Field of Search ..... 347/14, 19, 37; 400/74

(56) References Cited

U.S. PATENT DOCUMENTS

| | | | | |
|---|---|---|---|---|
| 4,272,771 A | | 6/1981 | Furukawa | 347/12 |
| 5,289,208 A | * | 2/1994 | Haselby | 347/19 |
| 5,359,355 A | | 10/1994 | Nagoshi et al. | 347/9 |
| 5,442,383 A | | 8/1995 | Fuse | 347/19 |
| 5,530,460 A | * | 6/1996 | Wehl | 347/19 |
| 5,534,895 A | | 7/1996 | Lindenfelser et al. | 347/19 |
| 5,621,440 A | | 4/1997 | Takahashi | 347/12 |
| 5,835,108 A | * | 11/1998 | Beauchamp et al. | 347/19 |
| 5,917,518 A | | 6/1999 | Ohashi et al. | 347/37 |
| 5,929,879 A | | 7/1999 | Karita et al. | 347/40 |
| 5,949,449 A | | 9/1999 | Takahashi | 347/40 |
| 5,956,055 A | | 9/1999 | Gibson et al. | 347/40 |
| 6,039,427 A | | 3/2000 | Kanome | 347/19 |
| 6,082,911 A | * | 7/2000 | Murakami | 400/74 |
| 6,089,766 A | | 7/2000 | Yamada et al. | 400/120.09 |
| 6,102,510 A | | 8/2000 | Kikuta et al. | 347/9 |
| 6,367,903 B1 | * | 4/2002 | Gast et al. | 347/9 |

OTHER PUBLICATIONS

Richard Dorf, The Electrical Engineering Handbook, 1997, Ron Powers, pp. 392–395.*

* cited by examiner

*Primary Examiner*—Lamson Nguyen
*Assistant Examiner*—Blaise Mouttet
(74) *Attorney, Agent, or Firm*—Thompson Hine, LLP; Jacqueline M. Daspit; Scott N. Barker

(57) ABSTRACT

A method for determining the skew of a printhead of a printer. At least three images are printed which are at least partially aligned substantially along the printhead scan direction with the middle image printed from one of the upper and lower portions of the printhead and with the adjacent images printed from the other of the upper and lower portions of the printhead. A sensor is moved in the printhead scan direction over the images. A function is calculated from the sensor output, wherein the calculated function indicates the skew of the printhead.

28 Claims, 5 Drawing Sheets

METHOD FOR DETERMINING THE SKEW OF A PRINTHEAD OF A PRINTER

TECHNICAL FIELD

The present invention relates generally to printers, and more particularly to a method for determining the skew of a printhead of a printer.

BACKGROUND OF THE INVENTION

Printers include those printers having a printhead which can print a vertical line along substantially the height of the printhead. For example, a typical ink jet printer has an ink jet printhead with a vertical array (or two or more vertical arrays) of ink jet nozzles which can print a vertical line along the height of the vertical array of ink jet nozzles. With the increasing size of printheads, skew becomes a significant source of ink dot misplacement. Skew (i.e., the offset from true vertical) occurs when the printhead is not perpendicular to the direction of printhead carrier travel. There are three main sources for skew error: if the printhead die is not correctly centered on the ink bottle; if the printhead carrier is angled as it is pulled from side to side during printing; and if paper movement is not perpendicular to the direction of printhead carrier travel. The effect of skew is that features in a print swath are misaligned from true vertical and that features in a subsequent print swath do not line up with the features printed on a prior print swath. For example, when printing a "vertical" line, the bottom of a "vertical" line segment in the first swath is not centered on the top of the "vertical" line segment in the subsequent print swath when skew is present.

Conventional methods for determining the skew of a printhead include a method requiring printing a first single-width "vertical" line, then partially advancing the paper, and then printing a second single-width "vertical" line to partially overlap the first line. The separation distance between the overlapped portions of the two "vertical" lines indicates the presence of skew. There will be no separation distance if there is no skew. In this method, a counter timer analyzes the output from a sensor to determine the amount of time it took for the sensor to cross from the lead edge of the first line to the trail edge of the second line. A central processing unit determines the distance between the lines from the elapsed time and from the known speed of the moving sensor.

What is needed is an improved method for determining the skew of a printhead of a printer.

SUMMARY OF THE INVENTION

A first method of the invention is for determining the skew of a printhead of a printer. The first method includes steps a) through e). Step a) includes printing first, second and third spaced-apart images at least partially aligned substantially along the printhead scan direction. The first and third images are printed by one of an upper portion and a lower portion of the printhead, and the second image is printed by the other of the upper portion and the lower portion of the printhead between the first and third images. In the absence of printhead skew the center of the second image is equidistant along the printhead scan direction from the centers of the first and third images. Step b) includes moving a sensor in the printhead scan direction over the first, second and third images. Step c) includes obtaining sampled data points from the sensor, wherein each sampled data point indicates the presence or absence of an image. Step d) includes calculating using the sampled data points the first, second and third centers of the respective first, second and third images. Step e) includes calculating a function of the first, second and third centers, wherein the calculated function indicates the skew of the printhead.

A second method of the invention is for determining the skew of a printhead of a printer. The second method includes steps a) through e). Step a) includes printing a first plurality of spaced-apart images and a second plurality of spaced-apart images. The images of the first and second pluralities are at least partially aligned substantially along the printhead scan direction. The images of the second plurality are spaced apart from and interleaved with the images of the first plurality. The images of the first plurality are printed by one of an upper portion and a lower portion of the printhead, and the images of the second plurality are printed by the other of the upper portion and the lower portion of the printhead. In the absence of printhead skew the center of each image of the second plurality is equidistant along the printhead scan direction from the centers of the adjacent images of the first plurality. Step b) includes moving a sensor in the printhead scan direction over the images of the first and second pluralities. Step c) includes obtaining sampled data points from the sensor, wherein each sampled data point indicates the presence or absence of an image. Step d) includes calculating using the sampled data points the centers of the images of the first and second pluralities. Step e) includes calculating a function of the centers of the images of the first and second pluralities, wherein the calculated function indicates the skew of the printhead.

A third method of the invention is for determining the skew of a printhead of a printer. The third method includes steps a) through c). Step a) includes printing first, second and third spaced-apart images at least partially aligned substantially along the printhead scan direction. The first and third images are printed by one of an upper portion and a lower portion of the printhead, and the second image is printed by the other of the upper portion and the lower portion of the printhead between the first and third images. In the absence of printhead skew the distance from the second image to the first image is equal to the distance from the second image to the third image. Step b) includes moving a sensor in the printhead scan direction over the first, second and third images. Step c) includes calculating a function of the output of the sensor, wherein the calculated function indicates the skew of the printhead.

A fourth method of the invention is for determining the skew of a printhead of a printer. The fourth method includes steps a) through c). Step a) includes printing a first plurality of spaced-apart images and a second plurality of spaced-apart images. The images of the first and second pluralities are at least partially aligned substantially along the printhead scan direction. The images of the second plurality are spaced apart from and interleaved with the images of the first plurality. The images of the first plurality are printed by one of an upper portion and a lower portion of the printhead, and the images of the second plurality are printed by the other of the upper portion and the lower portion of the printhead. In the absence of printhead skew the distance from each image of the second plurality is equidistant along the printhead scan direction from the adjacent images of the first plurality. Step b) includes moving a sensor in the printhead scan direction over the images of the first and second pluralities. Step c) includes calculating a function of the output of the sensor, wherein the calculated function indicates the skew of the printhead.

Several benefits and advantages are derived from one or more of the four methods of invention. By printing images, such as rectangular blocks, the block size can be chosen to fill the field of view of the sensor which will improve the signal-to-noise level of the sensor and which, in one example, should improve resolution from generally 1/300-inch (if a single pixel width image is used) to generally 1/1200-inch (if a rectangular block which fills the field of view of the sensor is used). By printing many images along the printhead scan direction, errors in calculating the function for the images will tend to average out because variations in the velocity of the sensor along an entire sensor scan will tend to average out.

DETAILED DESCRIPTION

Figure 1:
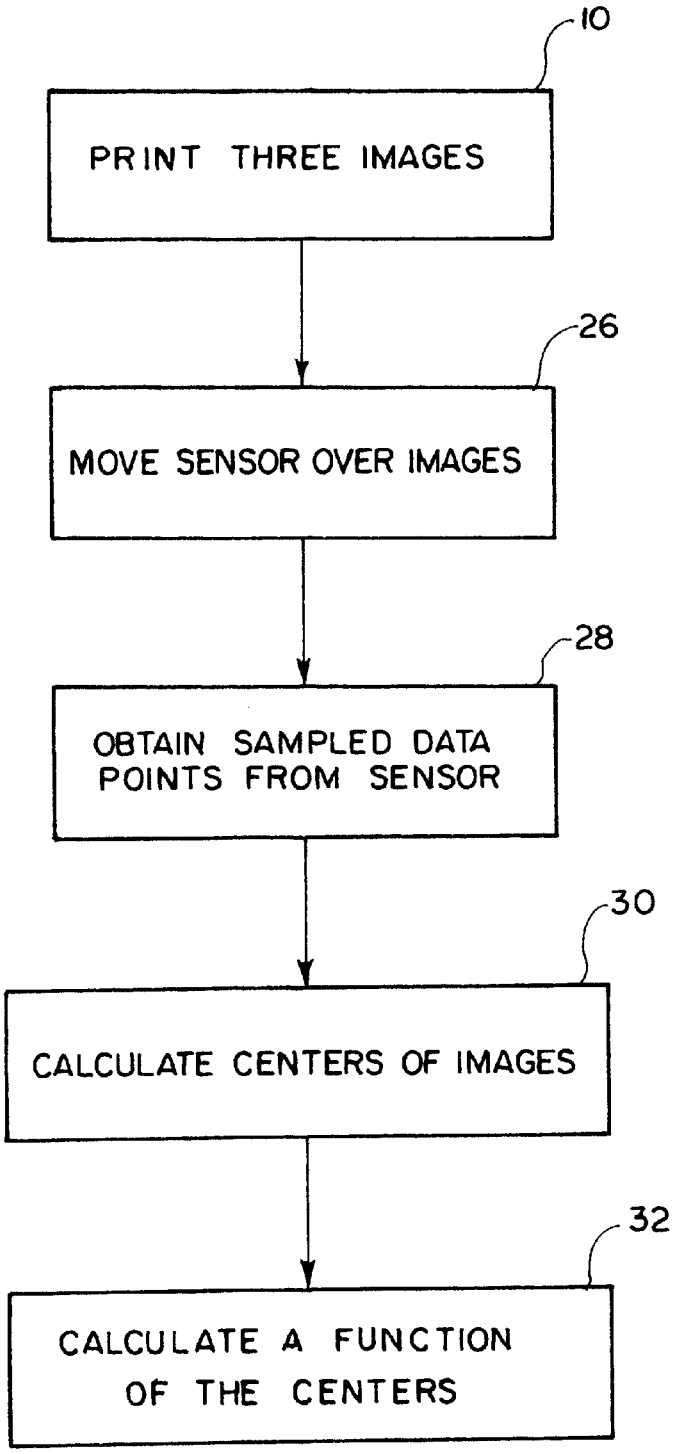
FIG. 1 is a block diagram of a first method of the invention.
Figure 2:
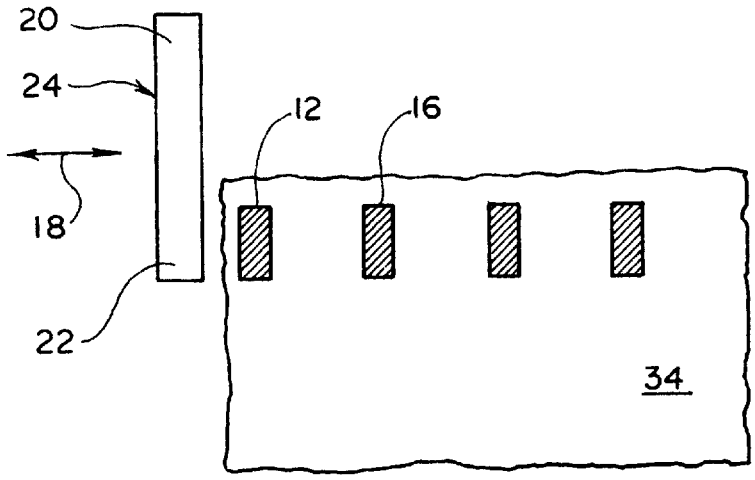
FIG. 2 is a schematic view showing a printhead and a first plurality of images printed by a lower portion of the printhead.
Figure 3:
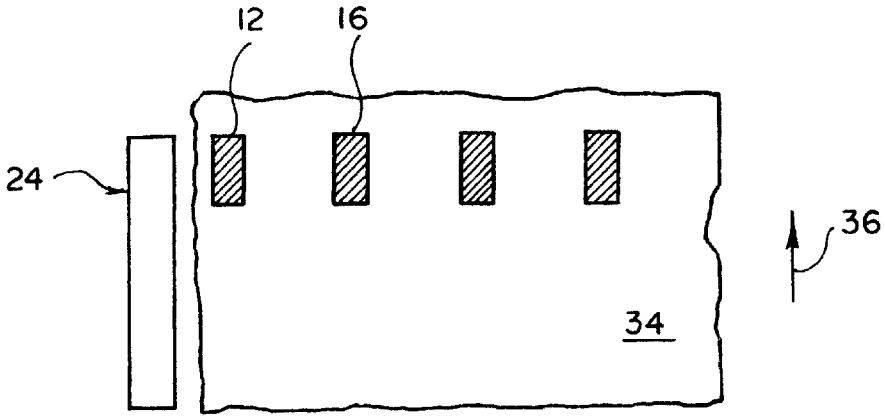
FIG. 3 is a schematic view, as in FIG. 2, but with the print medium partially advanced aligning the first plurality of images with an upper portion of the printhead.
Figure 4:
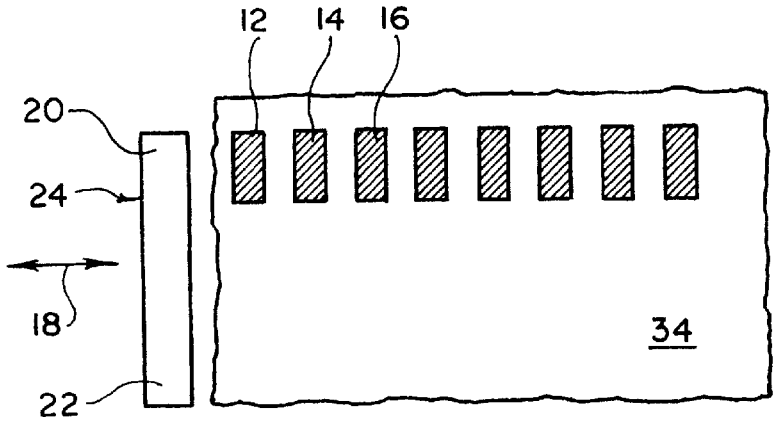
FIG. 4 is a schematic view, as in FIG. 3, but also showing the second plurality of images printed by the upper portion of the printhead.

A first method of the invention is for determining the skew of a printhead of a printer and is shown in block diagram form in FIG. 1. The method includes steps a) through e). Step a) is shown in block 10 of FIG. 1 and is labeled "Print Three Images". One implementation of step a) is shown in FIGS. 2 through 4. Step a) includes printing first, second and third spaced-apart images 12, 14 and 16 at least partially aligned substantially along the printhead scan direction 18, wherein the first and third images 12 and 16 are printed by one of an upper portion 20 and a lower portion 22 of the printhead 24, and wherein the second image 14 is printed by the other of the upper portion 20 and the lower portion 22 of the printhead 24 between the first and third images 12 and 16 so that in the absence of printhead skew the center of the second image 14 is equidistant along the printhead scan direction 18 from the centers of the first and third images 12 and 16. Step b) is shown in block 26 of FIG. 1 and is labeled "Move Sensor Over Images". Step b) includes moving a sensor in the printhead scan direction 18 over the first, second and third images 12, 14 and 16. Step c) is shown in block 28 of FIG. 1 and is labeled "Obtain Sampled Data Points From Sensor". Step c) includes obtaining sampled data points from the sensor, wherein each sampled data point indicates the presence or absence of an image. Step d) is shown in block 30 of FIG. 1 and is labeled "Calculate A Function Of The Centers". Step d) includes calculating using the sampled data points the first, second and third centers of the respective first, second and third images 12, 14 and 16. Step e) is shown in block 32 of FIG. 1 and is labeled "Calculate Differences Between Distances Between Adjacent Centers". Step e) includes calculating a function of the first, second and third centers, wherein the calculated function indicates the skew of the printhead 24.

In one implementation of step a), as shown in FIGS. 2 through 4, step a) includes substeps (1) through (3). Substep (1), as shown in FIG. 2, includes printing the first and third images 12 and 16 on a print medium 34 with the lower portion 22 of the printhead 24. Substep (2), as shown in FIG. 4, includes, after substep (1), printing the second image 14 on the print medium 34 with the upper portion 20 of the printhead 24. Substep (3), as shown in FIG. 3, includes advancing the print medium 34 between substeps (1) and (2) along a print-medium feed direction 36 substantially perpendicular to the printhead scan direction 18.

In another implementation of step a), not shown in the figures, step a) includes substeps (1) through (3). Substep (1) includes printing the second image on a print medium with the lower portion of the printhead. Substep (2) includes, after substep (1), printing the first and third images on the print medium with the upper portion of the printhead. Substep (3) includes advancing the print medium between substeps (1) and (2) along a print-medium feed direction substantially perpendicular to the printhead scan direction.

In one example, the lower portion 22 of the printhead 24 does not overlap the upper portion 20 of the printhead 24. In the same or a different example, the first, second and third images 12, 14 and 16 are substantial identical. In one variation, the first image 12 (and the second and third images 14 and 16) is a substantially rectangular block.

In one application, after step c) the sampled data points are stored in a computer memory, and step d) calculates the first, second and third centers using the stored sampled data points. In one variation, the sampled data points are stored in RAM firmware of the printer. In the same or a different variation, the sampled data points have one of first and second binary values, wherein the first binary value indicates the absence of an image, and wherein the second binary value indicates the presence of an image. In the same or a different application, step d) calculates the first, second and third centers also using the sampling rate and the velocity of the sensor.

In one embodiment, the sensor is an optical reflective sensor. In the same or a different embodiment, the printhead 24 has a plurality of nozzles, and the printer is an ink jet printer. In one example, the sensor moves at five inches per second and has a sampling rate of 5,000 samples per second. The blocks are substantially 48/600-inch wide (corresponding to a 48 pixel-wide block where a pixel is 1/600-inch) and generally 48/600-inch apart. In the absence of skew, data points 1–80 would have a value of zero indicating the presence of a block (the first image 12), data points 81–160 would have a value of one indicating the absence of a block, data points 161–240 would have a value of zero indicating the presence of a block (the second image 14), data points 241–320 would have a value of one indicating the absence of a block, and data points 321–400 would have a value of zero indicating the presence of a block (the third image 16). In one illustration, the data point number for the center of a block is calculated by $F+[(L-F)/2]$ where L is the last data point number for the block and F is the first data point number for the block. For the block of the first image 12, F=1 and L=80. Up to 7000 sampled data points are stored in RAM firmware of the printer. Using the data points, the center of each block is determined, say at the 40th data point for the first image 12, at the 199th data point for the second image 14 and at the 360th data point for the third image 16. Then, (40+360)/2=200 would be the data point of the center of the second image 14 assuming no skew. The "assumingno-skew" center of 200 is compared with the calculated center of 199 yielding a calculated skew of 1, indicating that the second image 14 should be moved a "distance" of 1 data point to correct for skew. In this example, the function in step e) is seen as averaging the centers of the first and third images 12 and 16 and comparing that to the center of the second image 14, wherein the difference indicates skew. Another function includes calculating the difference between the distance of the second center to the first center and the distance of the second center to the third center, wherein the difference indicates the skew of the printhead. Other functions are left to the artisan. One technique of correcting for a known skew error is presented in U.S. Pat. No. 5,956,055. Another technique of correcting for a known skew error involves address re-sequencing for firing the fire groups of a redundant nozzle printhead which keeps the same fixed time delay between sequentially-fired fire groups, and by re-mapping of print data by the formatter which sends data to different nozzles resulting in the bottom half of a "vertical" line segment of a print swath to be offset from the top half, as can be appreciated by those skilled in the art.

Figure 5:
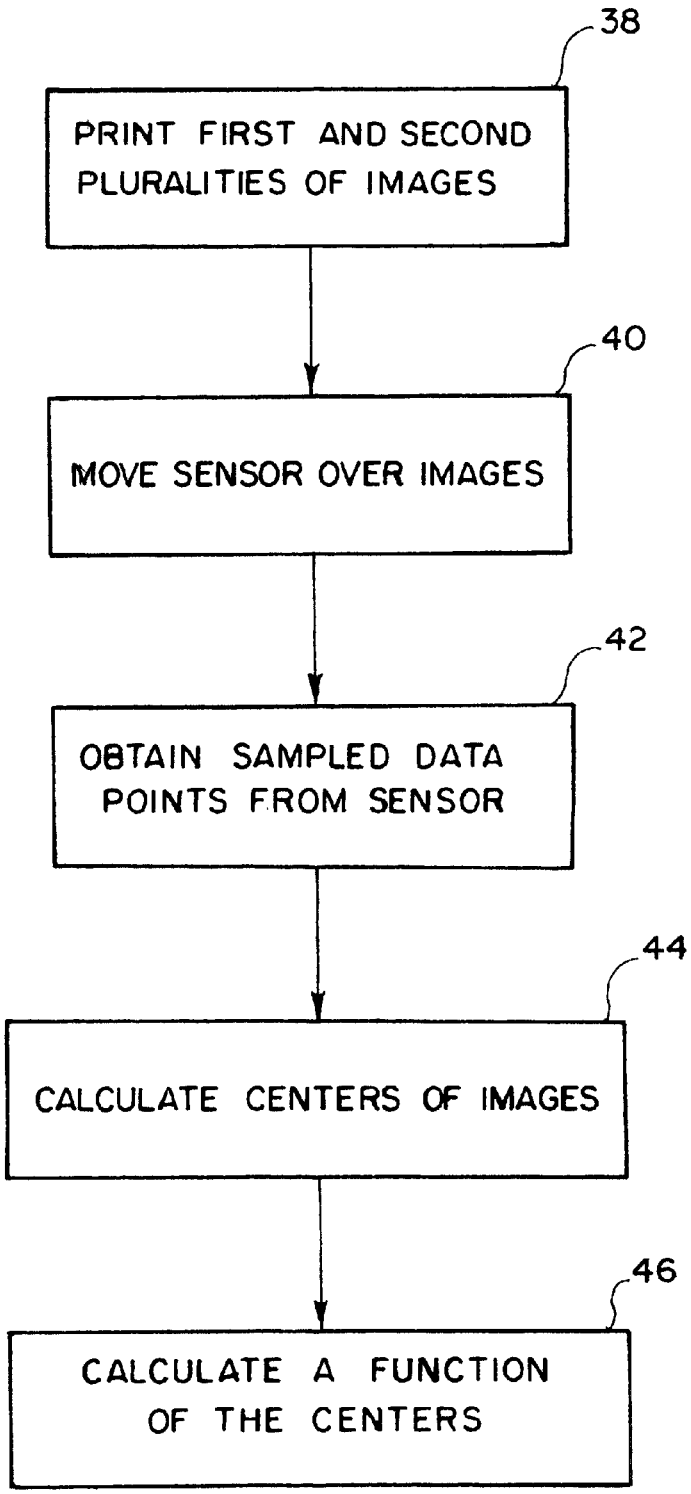
FIG. 5 is a block diagram of a second method of the invention.

A second method of the invention is for determining the skew of a printhead of a printer and is shown in block diagram form FIG. 5. The method includes steps a) through e). Step a) is shown in block 38 of FIG. 5 and is labeled "Print First And Second Pluralities Of Images". Step a) includes printing a first plurality of spaced-apart images and a second plurality of spaced-apart images, wherein the images of the first and second pluralities are at least partially aligned substantially along the printhead scan direction, wherein the images of the second plurality are spaced apart from and interleaved with the images of the first plurality, wherein the images of the first plurality are printed by one of an upper portion and a lower portion of the printhead, and wherein the images of the second plurality are printed by the other of the upper portion and the lower portion of the printhead so that in the absence of printhead skew the center of each image of the second plurality is equidistant along the printhead scan direction from the centers of the adjacent images of the first plurality. Step b) is shown in block 40 of FIG. 5 and is labeled "Move Sensor Over Images". Step b) includes moving a sensor in the printhead scan direction over the images of the first and second pluralities. Step c) is shown in block 42 of FIG. 5 and is labeled "Obtain Sampled Data Points From Sensor". Step c) includes obtaining sampled data points from the sensor, wherein each sampled data point indicates the presence or absence of an image. Step d) is shown in block 44 of FIG. 5 and is labeled "Calculate Centers Of Images". Step d) includes calculating using the sampled data points the centers of the images of the first and second pluralities. Step e) is shown in block 46 of FIG. 5 and is labeled "Calculate A Function Of The Centers". Step e) includes calculating a function of the centers of the images of the first and second pluralities, wherein the calculated function indicates the skew of the printhead. Examples of functions in step e) include those previously described for the first method of the invention, wherein, in one application, an averaging of skew calculations for different three block sets is performed for the second method of the invention.

In one implementation, step a) includes substeps (1) through (3). Substep (1) includes printing the first plurality of images on a print medium with the lower portion of the printhead. Substep (2) includes, after substep (1), printing the second plurality of images on the print medium with the upper portion of the printhead. Substep (3) includes advancing the print medium between substeps (1) and (2) along a print-medium feed direction substantially perpendicular to the printhead scan direction.

In another implementation, step a) includes substeps (1) through (3). Substep (1) includes printing the second plurality of images on a print medium with the lower portion of the printhead. Substep (2) includes, after substep (1), printing the first plurality of images on the print medium with the upper portion of the printhead. Substep (3) includes advancing the print medium between substeps (1) and (2) along a print-medium feed direction substantially perpendicular to the printhead scan direction.

In one example, the lower portion of the printhead does not overlap the upper portion of the printhead. In the same or a different example, the images of the first and second pluralities are substantial identical. In one variation, the images of the first and second pluralities are rectangular blocks.

In one application, after step c) the sampled data points are stored in a computer memory, and step d) calculates the centers of the images of the first and second pluralities using the stored sampled data points. In one variation, the sampled data points are stored in RAM firmware of the printer. In the same or a different variation, the sampled data points have one of first and second binary values, wherein the first binary value indicates the absence of an image, and wherein the second binary value indicates the presence of an image. In the same or a different application, step d) calculates the centers of the images of the first and second pluralities also using the sampling rate and the velocity of the sensor.

In one embodiment, the sensor is an optical reflective sensor. In the same or a different embodiment, the printhead has a plurality of nozzles, and the printer is an ink jet printer.

Figure 6:
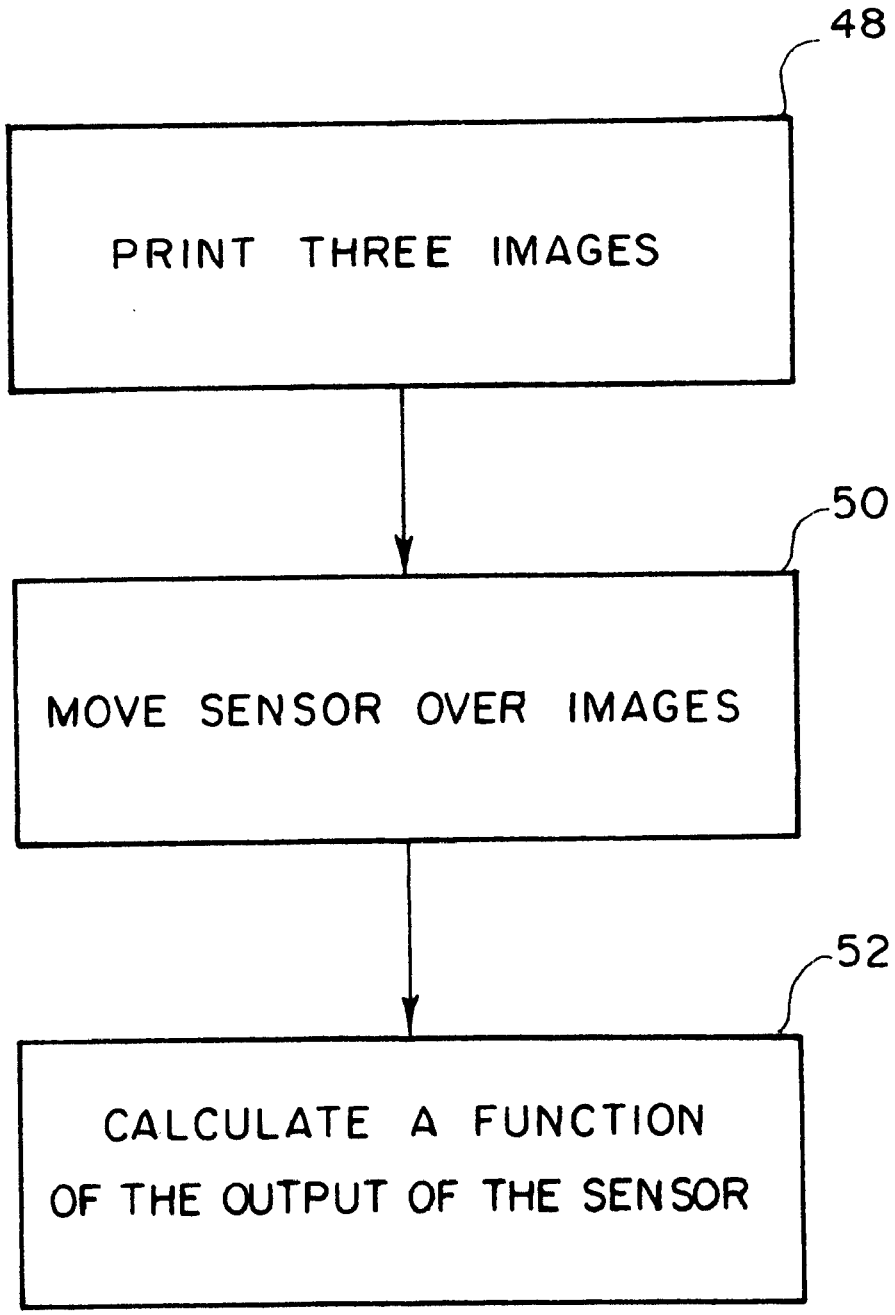
FIG. 6 is a block diagram of a third method of the invention.

A third method of the invention is for determining the skew of a printhead of a printer and is shown in block diagram form FIG. 6. The method includes steps a) through c). Step a) is shown in block 48 of FIG. 6 and is labeled "Print Three Images". Step a) includes printing first, second and third spaced-apart images at least partially aligned substantially along the printhead scan direction, wherein the first and third images are printed by one of an upper portion and a lower portion of the printhead, and wherein the second image is printed by the other of the upper portion and the lower portion of the printhead between the first and third images so that in the absence of printhead skew the distance from the second image to the first image is equal to the distance from the second image to the third image. Step b) is shown in block 50 of FIG. 6 and is labeled "Move Sensor Over Images". Step b) includes moving a sensor in the printhead scan direction over the first, second and third images. Step c) is shown in block 52 of FIG. 6 and is labeled "Calculate A Function Of The Output Of The Sensor". Step c) includes calculating a function of the output of the sensor, wherein the calculated function indicates the skew of the printhead. Examples of functions in step c) include those previously described for step e) of the first method of the invention. Other examples of functions include calculating the distance (from a timer sensor or a sampled-data-points sensor or another type of sensor) between adjacent images or the distance between the leading edges or between the trailing edges of adjacent images, wherein a difference in the distances indicates the skew of the printhead.

In one example, the first, second and third images are sized to each completely fill the field of view of the sensor. In the same or a different example, the first, second and third images are substantially identical rectangular blocks.

Figure 7:
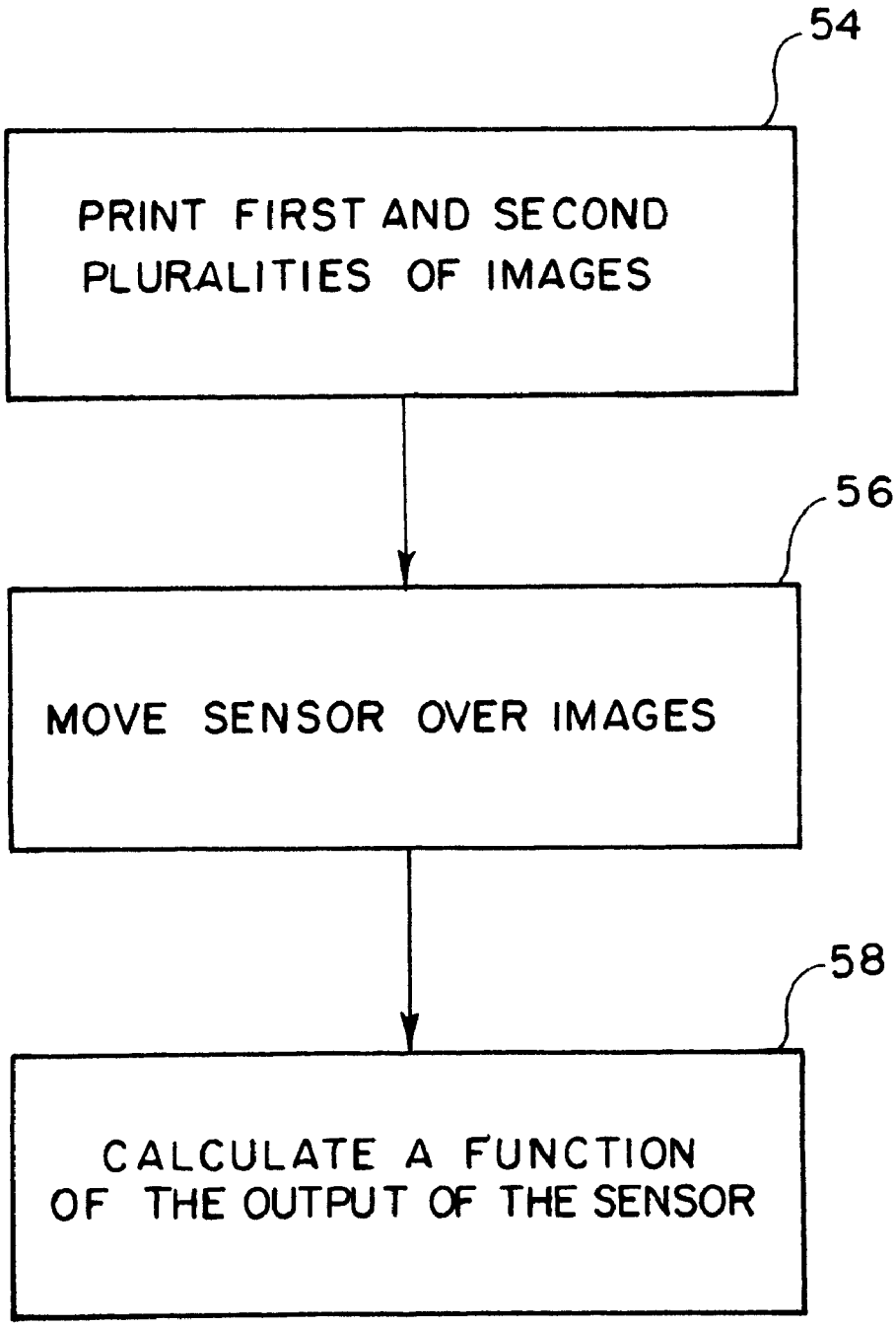
FIG. 7 is a block diagram of a fourth method of the invention.

A fourth method of the invention is for determining the skew of a printhead of a printer and is shown in block diagram form FIG. 7. The method includes steps a) through c). Step a) is shown in block 54 of FIG. 7 and is labeled "Print First And Second Pluralities Of Images". Step a) includes printing a first plurality of spaced-apart images and a second plurality of spaced-apart images, wherein the images of the first and second pluralities are at least partially aligned substantially along the printhead scan direction, wherein the images of the second plurality are spaced apart from and interleaved with the images of the first plurality, wherein the images of the first plurality are printed by one of an upper portion and a lower portion of the printhead, and wherein the images of the second plurality are printed by the other of the upper portion and the lower portion of the printhead so that in the absence of printhead skew the distance from each image of the second plurality is equidistant along the printhead scan direction from the adjacent images of the first plurality. Step b) is shown in block 56 of FIG. 7 and is labeled "Move Sensor Over Images". Step b) includes moving a sensor in the printhead scan direction over the images of the first and second pluralities. Step c) is shown in block 58 of FIG. 7 and is labeled "Calculate A Function Of The Output Of The Sensor". Step c) includes calculating a function of the output of the sensor, wherein the calculated function indicates the skew of the printhead. Examples of functions in step c) include those previously described for the third methods of the invention, wherein, in one application, an averaging of skew calculations for different three block sets is performed for the fourth method of the invention.

In one example, the images of the first and second pluralities are sized to each completely fill the field of view of the sensor. In the same or a different example, the images of the first and second pluralities together include at least twenty substantially identical rectangular blocks. In the same or a different example, the images of the first and second pluralities together extend along the printhead scan direction from substantially the first print location of a line to substantially the last print location of the line.

It is noted that applicable examples, applications, embodiments, etc. of one of the previously described four method of the invention may be employed by one or more of the other of the previously described four methods of the invention.

Several benefits and advantages are derived from one or more of the four methods of invention. By printing images, such as rectangular blocks, the block size can be chosen to fill the field of view of the sensor which will improve the signal-to-noise level of the sensor and which, in one example, should improve resolution from generally 1/300-inch (if a single pixel width image is used) to generally 1/1200-inch (if a rectangular block which fills the field of view of the sensor is used). By printing many images along the printhead scan direction, errors in calculating the function for the images will tend to average out because variations in the velocity of the sensor along an entire sensor scan will tend to average out.

The foregoing description of several methods of the invention has been presented for purposes of illustration. It is not intended to be exhaustive or to limit the invention to the precise methods disclosed, and obviously many modifications and variations are possible in light of the above teaching. It is intended that the scope of the invention be defined by the claims appended hereto.

What is claimed is:

1. A method for determining the skew of a printhead of a printer, wherein the method comprises the steps of:

a) printing first, second and third spaced-apart images at least partially aligned substantially along the printhead scan direction, wherein the first and third images are printed by one of an upper portion and a lower portion of the printhead, and wherein the second image is printed by the other of the upper portion and the lower portion of the printhead between the first and third images so that in the absence of printhead skew the center of the second image is equidistant along the printhead scan direction from the centers of the first and third images;

b) moving a sensor at a velocity in the printhead scan direction over the first, second and third images;

c) obtaining temporally sampled data points from the sensor for the entire sensor movement of step b), wherein each sampled data point indicates the presence or absence of an image;

d) storing all of the sampled data points in a memory, wherein the memory contains all of the sampled data points at the same time;

e) calculating using the stored sampled data points the first, second and third centers of the respective first, second and third images; and f) calculating a function of the first, second and third centers, wherein the calculated function indicates the skew of the printhead.

2. The method of claim 1, wherein step a) includes the following substeps:

(1) printing the first and third images on a print medium with the lower portion of the printhead;

(2) after substep (1), printing the second image on the print medium with the upper portion of the printhead; and (3) advancing the print medium between substeps (1) and (2) along a print-medium feed direction substantially perpendicular to the printhead scan direction.

3. The method of claim 1, wherein step a) includes the following substeps:

(1) printing the second image on a print medium with the lower portion of the printhead;

(2) after substep (1), printing the first and third images on the print medium with the upper portion of the printhead; and (3) advancing the print medium between substeps (1) and (2) along a print-medium feed direction substantially perpendicular to the printhead scan direction.

4. The method of claim 1, wherein the lower portion of the printhead does not overlap the upper portion of the printhead.

5. The method of claim 1, wherein the first, second and third images are substantially identical.

6. The method of claim 5, wherein the first image is a substantially rectangular block.

7. The method of claim 1, wherein step d) calculates the first, second and third centers also using the sampling rate and the velocity of the sensor.

8. The method of claim 1, wherein the sampled data points are stored in RAM firmware of the printer.

9. The method of claim 1, wherein the sampled data points have one of first and second binary values, wherein the first binary value indicates the absence of an image, and wherein the second binary value indicates the presence of an image.

10. The method of claim 1, wherein the sensor is an optical reflective sensor.

11. The method of claim 1, wherein the printhead has a plurality of nozzles, and wherein the printer is an ink jet printer.

12. A method for determining the skew of a printhead of a printer, wherein the method comprises the steps of:

a) printing a first plurality of spaced-apart images and a second plurality of spaced-apart images, wherein the images of the first and second pluralities are at least partially aligned substantially along the printhead scan direction, wherein the images of the second plurality are spaced apart from and interleaved with the images of the first plurality, wherein the images of the first plurality are printed by one of an upper portion and a lower portion of the printhead, and wherein the images of the second plurality are printed by the other of the upper portion and the lower portion of the printhead so that in the absence of printhead skew the center of each image of the second plurality is equidistant along the printhead scan direction from the centers of the adjacent images of the first plurality;

b) moving a sensor at a velocity in the printhead scan direction over the images of the first and second pluralities;

c) obtaining temporally sampled data points from the sensor for the entire sensor movement of step b), wherein each sampled data point indicates the presence or absence of an image;

d) storing all of the sampled data points in a memory, wherein the memory contains all of the sampled data points at the same time;

e) calculating using the stored sampled data points the centers of the images of the first and second pluralities; and f) calculating a function of the centers of the images of the first and second pluralities, wherein the calculated function indicates the skew of the printhead.

13. The method of claim 12, wherein step a) includes the following substeps:

(1) printing the first plurality of images on a print medium with the lower portion of the printhead;

(2) after substep (1), printing the second plurality of images on the print medium with the upper portion of the printhead; and (3) advancing the print medium between substeps (1) and (2) along a print-medium feed direction substantially perpendicular to the printhead scan direction.

14. The method of claim 12, wherein step a) includes the following substeps:

(1) printing the second plurality of images on a print medium with the lower portion of the printhead;

(2) after substep (1), printing the first plurality of images on the print medium with the upper portion of the printhead; and (3) advancing the print medium between substeps (1) and (2) along a print-medium feed direction substantially perpendicular to the printhead scan direction.

15. The method of claim 12, wherein the lower portion of the printhead does not overlap the upper portion of the printhead.

16. The method of claim 12, wherein the images of the first and second pluralities are substantially identical.

17. The method of claim 16, wherein the images of the first and second pluralities are substantially rectangular blocks.

18. The method of claim 12, wherein step d) calculates the centers of the images of the first and second pluralities also using the sampling rate and the velocity of the sensor.

19. The method of claim 12, wherein the sampled data points are stored in RAM firmware of the printer.

20. The method of claim 12, wherein the sampled data points have one of first and second binary values, wherein the first binary value indicates the absence of an image, and wherein the second binary value indicates the presence of an image.

21. The method of claim 12, wherein the sensor is an optical reflective sensor.

22. The method of claim 12, wherein the printhead has a plurality of nozzles, and wherein the printer is an ink jet printer.

23. The method of claim 12, wherein the function includes averaging.

24. A method for determining the skew of a printhead of a printer, wherein the method comprises the steps of:

a) printing first, second and third spaced-apart images at least partially aligned substantially along the printhead scan direction, wherein the first and third images are printed by one of an upper portion and a lower portion of the printhead, and wherein the second image is printed by the other of the upper portion and the lower portion of the printhead between the first and third images so that in the absence of printhead skew the distance from the second image to the first image is equal to the distance from the second image to the third image;

b) moving a sensor in the printhead scan direction over the first, second and third images; and c) calculating a function of the output of the sensor, wherein the calculated function indicates the skew of the printhead, wherein the first, second and third images are sized to each completely fill the field of view of the sensor.

25. The method of claim 24, wherein the first, second and third images are substantially identical rectangular blocks.

26. A method for determining the skew of a printhead of a printer, wherein the method comprises the steps of:

a) printing a first plurality of spaced-apart images and a second plurality of spaced-apart images, wherein the images of the first and second pluralities are at least partially aligned substantially along the printhead scan direction, wherein the images of the second plurality are spaced apart from and interleaved with the images of the first plurality, wherein the images of the first plurality are printed by one of an upper portion and a lower portion of the printhead, and wherein the images of the second plurality are printed by the other of the upper portion and the lower portion of the printhead so that in the absence of printhead skew the distance from each image of the second plurality is equidistant along the printhead scan direction from the adjacent images of the first plurality;

b) moving a sensor in the printhead scan direction over the images of the first and second pluralities; and c) calculating a function of the output of the sensor, wherein the calculated function indicates the skew of the printhead, wherein the images of the first and second pluralities are sized to each completely fill the field of view of the sensor.

27. The method of claim 26, wherein the images of the first and second pluralities together include at least twenty substantially identical rectangular blocks.

28. The method of claim 27, wherein the images of the first and second pluralities together extend along the printhead scan direction from substantially the first print location of a line to substantially the last print location of the line.

* * * * *